US006139065A

United States Patent [19]

Washburn et al.

[11] Patent Number: 6,139,065

[45] Date of Patent: Oct. 31, 2000

[54] PROCESS FOR MAKING SECURITY PAPER

[75] Inventors: David Ernest Washburn, Kettering; Rajendra Mehta, Dayton; Harry Allen Seifert, Kettering, all of Ohio

[73] Assignee: The Standard Register Company, Dayton, Ohio

[21] Appl. No.: 09/328,200

[22] Filed: Jun. 8, 1999

Related U.S. Application Data

[62] Division of application No. 08/865,136, May 29, 1997, Pat. No. 5,961,152.

[51] Int. Cl.[7] ..... B42D 15/00

[52] U.S. Cl. ..... 283/67; 283/83

[58] Field of Search ..... 283/67, 70, 72, 283/82, 83, 91, 85, 113, 901; 428/916, 915

[56] References Cited

U.S. PATENT DOCUMENTS

| | | | |
|---|---|---|---|
| 3,880,706 | 4/1975 | Williams | 162/140 X |
| 4,462,866 | 7/1984 | Tooth et al. | 162/140 X |
| 4,500,777 | 2/1985 | Drexler | 235/487 |
| 4,534,398 | 8/1985 | Crane | 162/103 |
| 4,618,167 | 10/1986 | Whitehead . | |
| 4,852,911 | 8/1989 | Hoppe | 283/82 |
| 4,889,366 | 12/1989 | Fabbiani | 283/83 X |
| 5,248,544 | 9/1993 | Kaule | 428/195 |
| 5,255,129 | 10/1993 | Jones | 360/40 |
| 5,324,079 | 6/1994 | Kaule et al. | 283/82 |
| 5,354,099 | 10/1994 | Kaule et al. | 283/85 |
| 5,383,687 | 1/1995 | Suess et al. | 283/86 |
| 5,423,732 | 6/1995 | Coe | 493/324 |
| 5,480,685 | 1/1996 | Suzuki et al. | 427/548 |
| 5,486,022 | 1/1996 | Crane | 283/83 |
| 5,509,691 | 4/1996 | Kaule et al. | 283/67 |
| 5,516,153 | 5/1996 | Kaule | 283/85 |
| 5,567,276 | 10/1996 | Boehm et al. | 162/140 X |
| 5,639,126 | 6/1997 | Dames et al. | 283/83 |
| 5,876,068 | 3/1999 | Schneider et al. | 283/86 |
| 5,944,927 | 8/1999 | Seifert . | |

*Primary Examiner*—Willmon Fridie, Jr.
*Attorney, Agent, or Firm*—Killworth, Gottman, Hagan & Schaeff, L.L.P.

[57] ABSTRACT

Security paper, security documents made from the security paper, and processes for making the security paper, are provided. A filament is bonded and embedded into paper which has previously been manufactured. The filament is bonded to the paper by an adhesive, or by heat and pressure. The filament is embedded into the paper by pressure applied by rolls. The filament may be imprinted with printed matter for visual confirmation of document authenticity. The filament may include any combination of security features, such as reflective filaments, fluorescent filaments, and high tensile strength filaments.

20 Claims, 5 Drawing Sheets

PROCESS FOR MAKING SECURITY PAPER

CROSS REFERENCE TO RELATED APPLICATIONS

This application is a division of U.S. patent application Ser. No. 08/865,136, filed May 29, 1997, now U.S. Pat. No. 5,961,152.

BACKGROUND OF THE INVENTION

The present invention generally relates to security paper and, in particular, to security paper having security threads, and to processes for making the security paper.

Many documents of value, such as bank notes, currency, checks, stock certificates, and bonds, are provided with security features for preventing illicit copying and forgery. One such security feature is the use of security paper which is not widely available and difficult to simulate. There are a number of known security features that may be included in security paper, one of which is the inclusion of threads of various materials in the paper.

Such security threads may typically consist of metallic threads, colored threads, optical threads or magnetic threads. Embedded metallic threads are not readily apparent in reflected light but are immediately apparent in transmitted light as a dark image of the threads is seen when the document is illuminated from behind. Metallic threads are simple in concept, but provide an effective anti-copying function. The optical feature of metallic threads cannot be copied by a photocopier or simulated by printing a line on the surface of the security paper.

Colored threads in security documents are typically apparent upon visual inspection under normal lighting, and are common in currency. Optical threads are filaments of material which are reflective, diffractive or fluorescent. Such threads are readily identifiable in ambient light or ultraviolet light. Magnetic threads are filaments of material that are typically identifiable by machine. Such threads may be formed of any one of a number of magnetic materials. Security threads of any of these types may be formed into readily identifiable characters for further visual confirmation of document authenticity.

Security threads are typically embedded into the security paper at the time that the paper is manufactured. Such a papermaking process is very expensive, adding significantly to the overall cost of the paper.

Accordingly, there remains a need in the art for security features which may be added to less expensive paper, after the paper is manufactured, thereby reducing the manufacturing costs of the security paper.

SUMMARY OF THE INVENTION

The present invention meets the aforementioned needs by providing security paper, security documents made with such paper, and a process for making the security paper which is simple and cost effective. A process for making the security paper comprises providing paper having an upper surface and a lower surface. At least one filament is provided and applied to one of the upper and lower surfaces of the paper. Pressure is applied to the at least one filament and the paper such that the filament is deformed. The at least one filament may be bonded to the paper using an adhesive or by heating the at least one filament. The adhesive may be applied to the at least one filament prior to applying the filament to the paper. The at least one filament may be heated and pressed to the paper simultaneously. Rolls, including a calendaring roll, may be used to apply pressure to the at least one filament and the paper. The calendaring roll may be heated or textured. The at least one filament may be pressed into the paper such that an upper surface of the at least one filament is substantially coplanar with the surface of the paper. Alternatively, the at least one filament may be pressed into the paper such that an upper surface of the at least one filament remains raised above the surface of the paper.

The at least one filament may comprise any of a number of materials, such as optically reflective materials, fluorescent materials, high tensile strength materials and thermoforming plastic materials. The adhesive may be a pressure sensitive adhesive and may comprise any of a number of materials, such as optically reflective materials and fluorescent materials. The paper may comprise a sheet of paper or a paper web.

The at least one filament may be substantially linear or curvilinear as the filament is applied to the paper along a substantially linear path or a curved path, respectively. The at least one filament may also extend in a direction which is substantially parallel to a machine direction of the paper as the filament is applied to the paper in a direction which is substantially parallel to the machine direction of the paper. The width of the at least one filament may be varied by varying at least one of the temperature, pressure, or tension of the at least one filament as the filament is applied to the paper. The at least one filament may be discontinuous and may further comprise a plurality of interdispersed elements.

The process may further comprise providing another filament which is applied to one of the upper and lower surfaces of the paper. Pressure may be then applied to the another filament and the paper such that the another filament is deformed. The at least one filament and the another filament may be applied to the same surface or opposite surfaces of the paper. The at least one filament and the another filament may overlap. The at least one filament may be a first color and the another filament may be second color. The first color may be different than the second color. The paper may be comprised of material selected from the group consisting of wood pulp, vegetable fibers and plant fibers.

According to another aspect of the present invention, a security paper comprises a paper having an upper surface and a lower surface and at least one filament. The at least one filament is mounted on and pressed into one of the upper and lower surfaces of the paper, such that the filament is deformed. The security paper may include additional features described above with respect to the process of making the security paper.

According to yet another aspect of the present invention, a security document comprises a security paper having an upper surface and a lower surface in which at least one of the upper and lower surfaces carries printed indicia. The security paper comprises a paper having an upper surface corresponding to the upper surface of the security paper, a lower surface corresponding to the lower surface of the security paper, and at least one filament. The at least one filament is mounted on and pressed to one of the upper and lower surfaces of the paper, such that the at least one filament is deformed. The security paper of the security document may include additional features described above with respect to the process of making the security paper.

Other objects and advantages of the invention will be apparent from the following description, the accompanying drawings and the appended claims.

DETAILED DESCRIPTION OF THE PREFERRED EMBODIMENTS

Figure 1A:
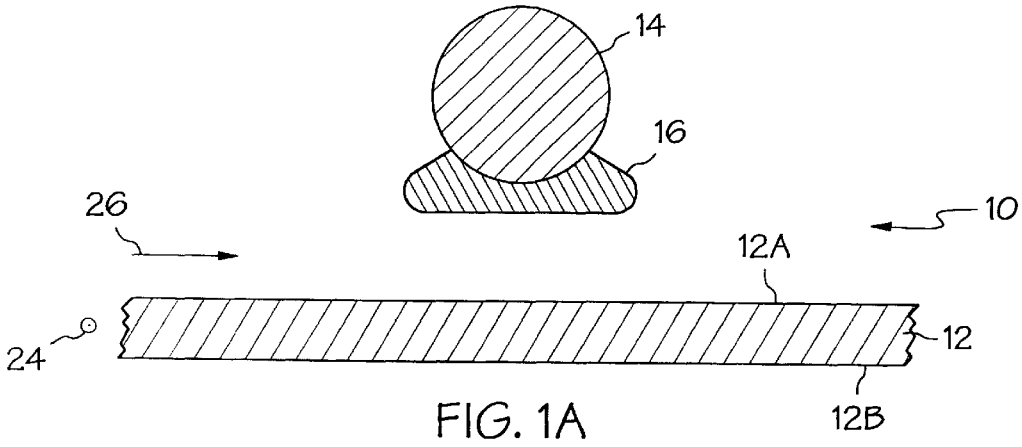
FIGS. 1A–1C are enlarged, partial sectional views depicting various manufacturing acts for making security paper according to an embodiment of the present invention.
Figure 1B:
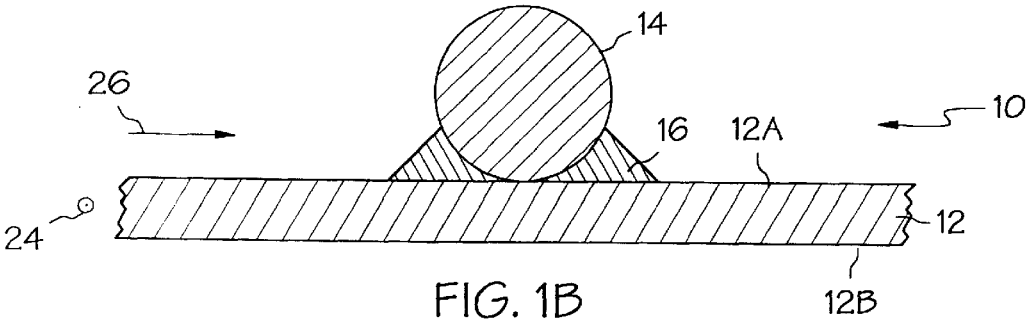
Figure 1C:
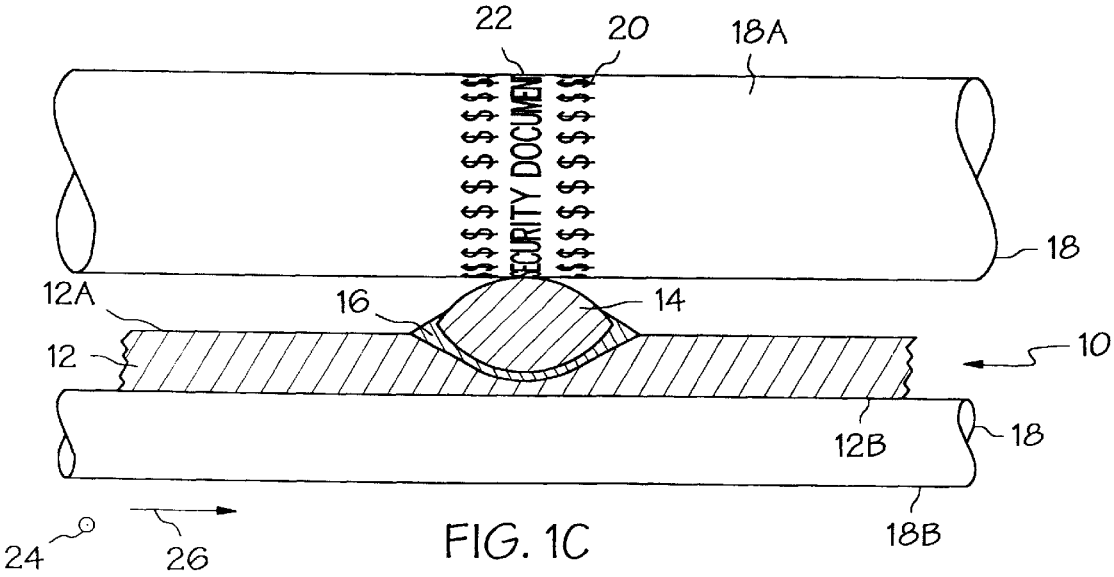

FIGS. 1A–1C illustrate a process for making security paper 10 according to a first embodiment of the present invention. It should be appreciated that these figures, as well as FIGS. 2, 3, 4B, 5A, and 5B, are greatly enlarged, not drawn to scale, and are presented solely for illustrative purposes. The balance of the figures are also not drawn to scale. As shown in FIG. 1A, paper 12 has an upper surface 12A and a lower surface 12B. While in the illustrated embodiment the paper 12 is comprised of wood pulp fibers, it will be appreciated to those skilled in the art, that the paper 12 may be comprised of a substrate made of any of a variety of suitable materials, such as vegetable fibers, plant fibers, additives, fillers, plastics, synthetics, polymeric films and combinations of such materials. Further, the paper 12 may be comprised of a web of paper material or individual sheets of paper material.

A filament 14 is provided in which an adhesive 16 has been applied. As shown in FIG. 1B, the filament 14 is applied to the upper surface 12A of the paper 12 and the adhesive 16 is cured, such that a bond is formed between the paper 12 and the filament 14. The means in which the adhesive 16 is cured depends, in part, on the type of adhesive 16 used. Any of a number of suitable adhesives may be used, such as roll applied ultraviolet (UV) adhesives, water base adhesives, and pressure sensitive adhesives. Accordingly, an ultraviolet light source may be used to cure the UV adhesive, a heater or infrared light source may be used to cure the water base adhesive, and a pressing device may be used to secure the pressure sensitive adhesive. It will be appreciated by those skilled in the art that the filament 14 may be bonded to the upper surface 12A of the paper 12 by applying the adhesive 16 to the paper 12 and then placing the filament 14 on the adhesive 16. As shown in the illustrated embodiment, the filament 14 is bonded to the paper 12 along a substantially straight or linear line. Further, the filament 14 is oriented in a machine direction 24 of the web of paper 12 which is out of the plane of the page of FIGS. 1–3. The machine direction 24 of the web of paper 12 is defined as the direction in which the web of paper 12 is passed as the security paper 10 is formed. However, it will be appreciated by those skilled in the art, that the filament 14 may be oriented in a cross-web direction 26 which is substantially perpendicular to the machine direction 24.

Figure 2:
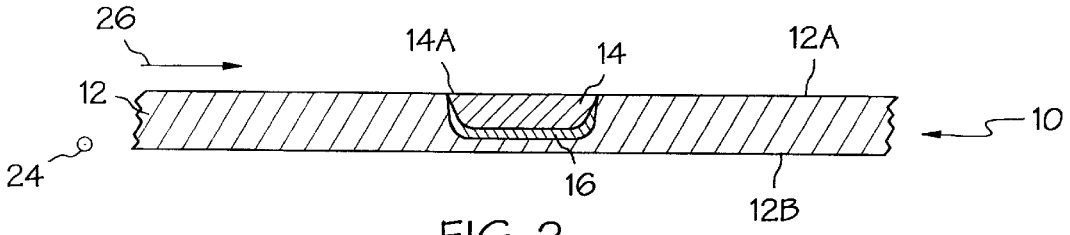
FIG. 2 is an enlarged, partial sectional view of the security paper of FIG. 1, constructed according to a first aspect of the present invention.
Figure 3:
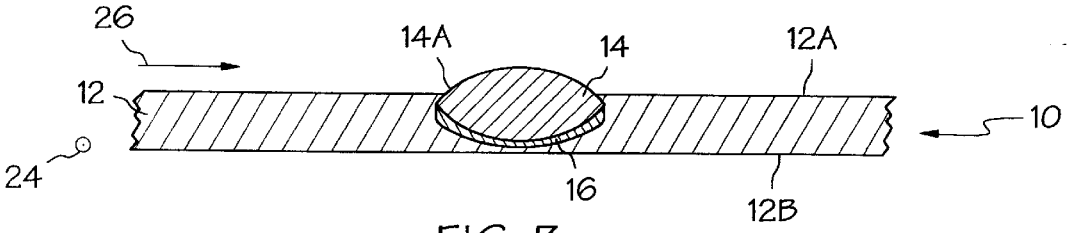
FIG. 3 is an enlarged, partial sectional view of the security paper of FIG. 1, constructed according to a second aspect of the present invention.

As shown in FIG. 1C, once a bond is formed between the filament 14 and the paper 12, pressure is applied to the filament 14 and the paper 12 so that the filament 14 is deformed. It will be appreciated that this step may be combined with the previous step in the event that a pressure sensitive adhesive is used. As shown in FIG. 2, the filament 14 may be pressed into the paper 12 so that an upper surface 14A of the filament 14 is substantially coplanar with the upper surface 12A of the paper 12. Alternatively, as shown in FIG. 3, the filament 14 may be pressed into the paper 12 so that the upper surface 14A of the filament 14 remains slightly raised above the upper surface 12A of the paper 12. With the filament 14 coplanar with the paper 12, a substantially flat and uniform upper surface 12A is presented. Consequently, the paper 12 may be stacked and folded easily, as there are no raised surfaces. On the other hand, a raised filament 14 provides an additional tactile security feature as the filament 14 may be perceived through the sense of touch.

As will be appreciated by those skilled in the art, the amount of pressure required to press the filament 14 into the paper 12 so that the filament 14 is either coplanar or slightly raised above the upper surface 12A of the paper 12, is dependent on the types of filament and paper used. In any case, the application of pressure to the filament 14 and the paper 12 causes the filament 14 to be deformed and embedded into the paper 12. Further, the amount of applied pressure is directly proportional to the extent to which the filament 14 is deformed, and to the degree into which the filament 14 is embedded into the paper 12. As the filament 14 is embedded into the paper 12, the paper 12 is compressed along the length of the filament 14. In the illustrative embodiment, the paper 12, comprised of wood pulp material, may be compressed up to approximately 60% of its nominal thicknesses under the application of approximately 400 lbs. per linear inch (PLI) of pressure. It should be apparent that the extent to which the paper 12 may be compressed is dependent on the type of paper and the amount of the applied pressure.

As shown in FIG. 1C, the filament 14 and the paper 12 are pressed together by rollers 18A, 18B. The filament 14 is deformed as the paper 12 and the filament 14 are passed between the rollers 18A, 18B, and at the same time the filament 14 is embedded into the paper 12, as described above. The arrangement of the rollers 18A, 18B is commonly known as a two-roll calendar, with the rollers 18A, 18B commonly known as calendaring rollers. The calendaring roll 18A may be heated to an appropriate temperature depending on the types of filaments, paper and adhesive. In the illustrated embodiment, a temperature greater than 400° F. may be used. The combination of heat and pressure further facilitates the deformation and embedment of the filament 14 into the paper 12.

Figure 4A:
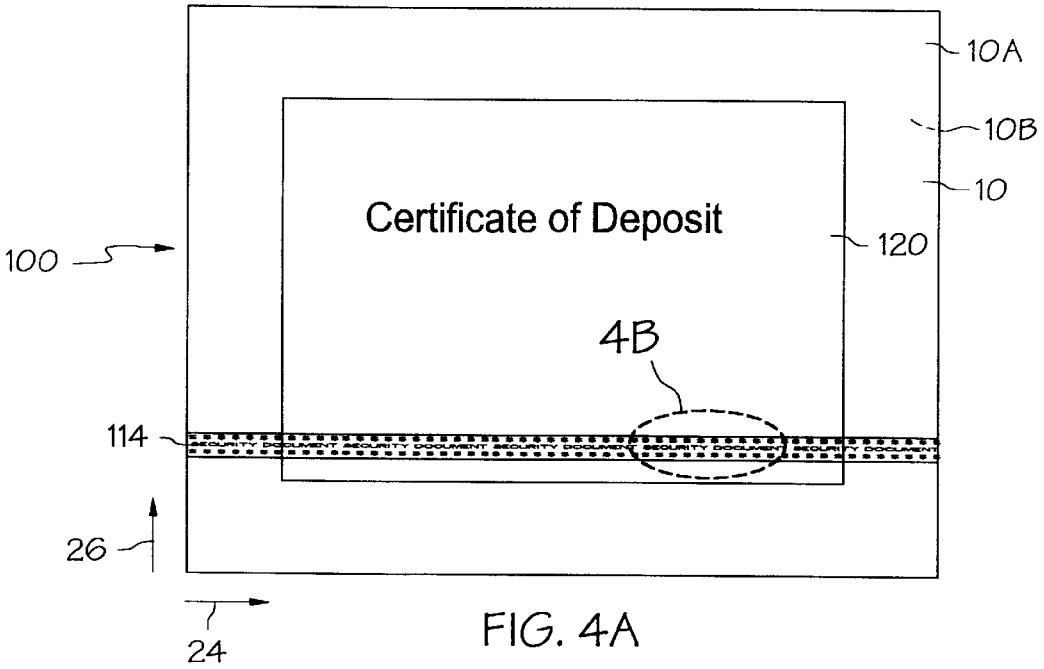
FIG. 4A is a plan view of a security document according to an embodiment the present invention.
Figure 4B:
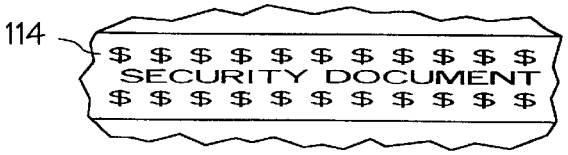
FIG. 4B is an enlarged partial view of the portion 4B (shown in FIG. 4A) of the security document of FIG. 4A.

The top calendaring roll 18A which contacts the filament 14 may be either smooth or textured. A smooth calendaring roll simply causes the filament 14 to deform. However, in the illustrated embodiment of FIG. 1C, the calendaring roll 18A includes a textured portion 20 having a textured pattern 22. The textured pattern 22 is imprinted into the filament 14 as the filament 14 passes under the textured portion 20 of the top calendaring roll 18A. The textured pattern may consist of symbols, letters, numbers or any combination of the same. In the illustrated embodiment, the filament 14 is applied to the paper 12 in a generally straight line substantially parallel to the machine direction 24 so that the filament 14 is imprinted by the textured portion 20 of the calendaring roll 18A. However, it will be appreciated by those skilled in the art that the position of the textured portion 20 may be varied so that the filament 14 may be applied to the paper 12 in other that a generally straight line substantially parallel to the machine direction 24. Alternatively, the top calendaring roll 18A may have its entire surfaces covered with a textured portion 20. As shown in FIGS. 4A and 4B, a security document 100 comprises a filament 114 having the imprinted textured pattern, "SECURITY DOCUMENT." The imprinted filament 114 provides an additional security feature, as the authenticity of the security document 100 may be visually confirmed.

Figure 5A:
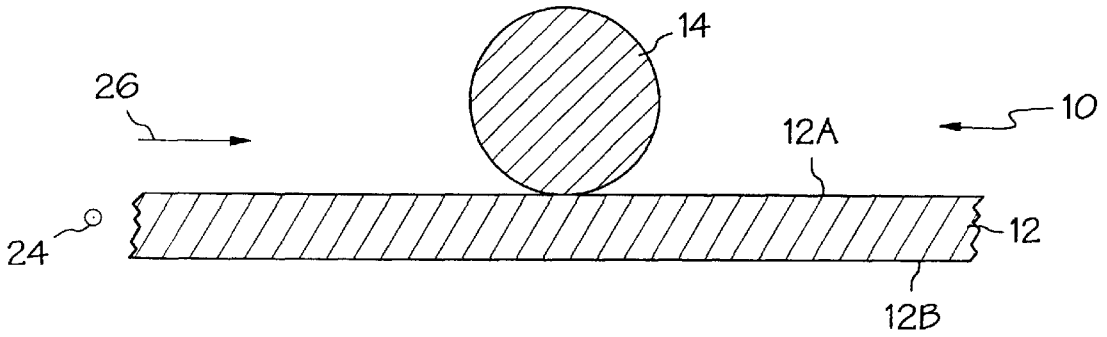
FIGS. 5A–5B are enlarged, partial sectional views of the security paper, depicting various manufacturing steps for making security paper according to a further embodiment of the present invention.
Figure 5B:
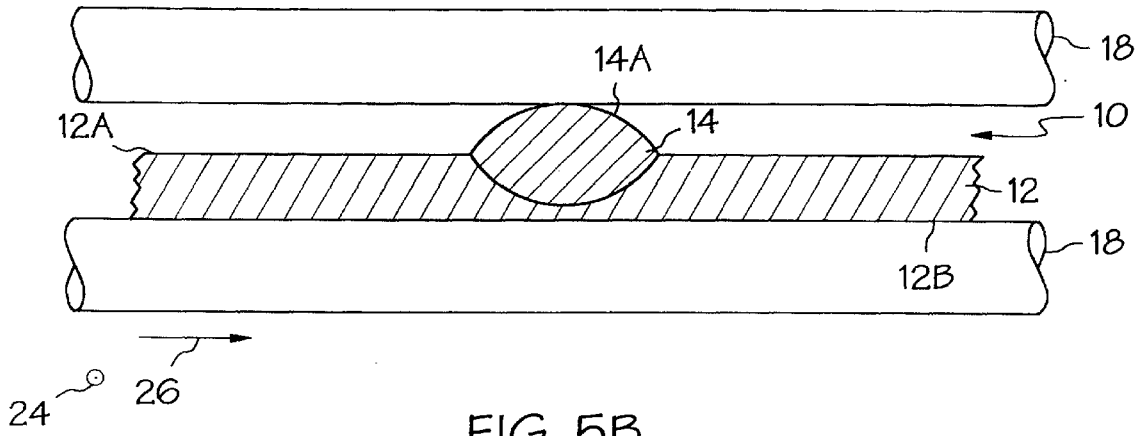

FIGS. 5A–5B illustrate a process for making security paper 10 according to a second embodiment of the present invention with those structures that correspond to the structures of the first embodiment having been numbered correspondingly. As shown in FIG. 5A, the filament 14 is positioned along the upper surface 12A of the paper 12. The filament 14 is then heated to an appropriate temperature. As shown in FIG. 5B, the heated filament 14 is pressed together with the paper 12 so that the filament 14 is deformed and bonded to the paper 12. In the illustrated embodiment, the filament 14 is heated to a temperature greater than 400° F. and pressed to the paper 12 simultaneously by the calendaring rolls 18A, 18B under the application of approximately 400 PLI of pressure. It should be apparent that the only difference between the two processes is that in the first embodiment, the filament 14 is bonded to the paper 12 via the adhesive 16, while in the second embodiment the filament 14 is bonded to the paper 12 via heat and pressure. Accordingly, the filament 14 may also be embedded into the paper 12 so that the upper surface 14A of the filament 14 is substantially coplanar or raised above the upper surface 12A of the paper 12. The filament 14 in the second embodiment may also be deformed and textured, as described above.

In the illustrated embodiment, the filament 14 is added to the paper 12 after the paper 12 is manufactured. For descriptive purposes, the paper 12 is transformed into the security paper 10 once the security element 22 is added to the paper 12. As described above, in the prior art it was typical for security features to be added to the paper during the paper manufacturing process, significantly increasing the costs of manufacture. Since the filament 14 may be added to the paper 12 after the paper 12 has been manufactured, virtually any manufactured paper may be used. The cost of producing the security paper 10 is significantly reduced as the paper 12 does not have to be specially designed or manufactured. Typically, paper processing facilities require large minimum order quantities which may be avoided if commodity grade paper is modified according to an embodiment of the present invention.

The filament 14 may be comprised of any of a number of materials which deform upon the application of sufficient heat or sufficient pressure, or both. In the embodiments in which the filament 14 is heated, a thermo-forming plastic material may be used. Thermo-forming plastic is a plastic, such as nylon, which becomes malleable upon the application of heat. A filament 14 composed of thermo-forming plastic may be readily deformed upon the application of heat and pressure.

The filament 14 may also be comprised of any of a number of high tensile strength materials, such as Kevlar and metallic wire. High tensile strength materials include materials having a tensile strength of at least 27,000 psi. A high tensile strength filament 14, which is deformed and embedded into the paper 12, increases the tear resistance of the paper 12. The paper 12 may be torn to the high tensile strength filament 14 at which point further tearing is prevented. The paper 12 may therefore be authenticated by tearing a portion of the paper 12.

The filament 14 may also be comprised of a combination of materials. For example, a plastic material, such as nylon, may be coated with any one of a number of metallic or magnetic materials. The resulting filament may be deformed and embedded into the paper 12, as described above. The security paper 10 will therefore include the inherent security features associated with metallic and magnetic materials as described above.

Further, the filament 14 may be comprised of optically reflective materials and/or fluorescent materials. An optically reflective material provides an added security feature to the security paper 10 since incident light is reflected from the filament 12 for visual or machine confirmation of document authenticity. Similarly, a fluorescent material provides an added security feature to the security paper 10 as incident light having a first wavelength is absorbed by the fluorescent material and light of a different wavelength is radiated by the fluorescent material. For example, the fluorescent material may be sensitive to light in the ultraviolet region, such that as ultraviolet light is projected onto the security paper 10, the filament 14 is illuminated, and a portion of the ultraviolet light is absorbed. The illuminated filament 14 radiates light in the visual region of the spectrum. Similarly, the adhesive 16 may include optically reflective materials or fluorescent materials for yet another added security feature of the security paper 10.

Figure 6:
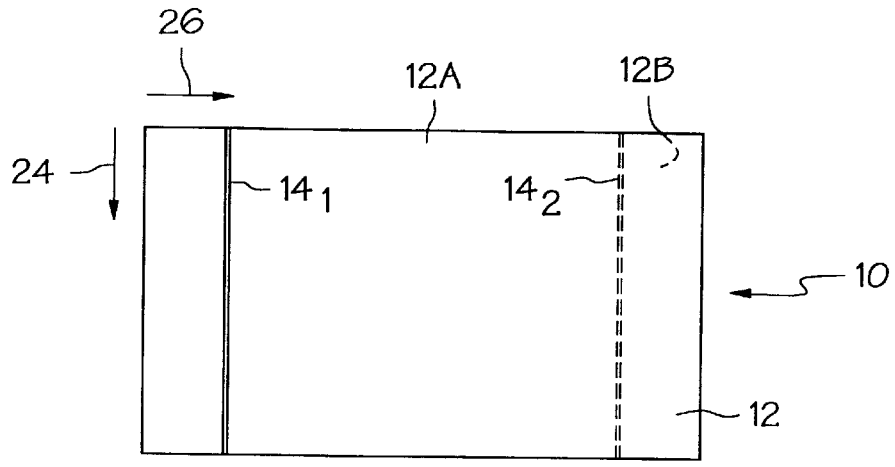
FIGS. 6–12 are plan views of security paper according to yet further embodiments of the present invention.

It should be apparent that more than one filament 14 may be applied to one or both of the surfaces 12A and 12B of the paper 12. If desired, a substantial number of filaments 14 may be applied to the paper 12. Further, the orientation of one or more of the filaments 14 may include one or more of the configurations shown in FIGS. 6–12. Referring to FIG. 6, a first filament $\mathbf{14}_1$ is applied to the upper surface 12A while a second filament $\mathbf{14}_2$ is applied to the lower surface 12B. The first and second filaments $\mathbf{14}_1$ and $\mathbf{14}_2$ may have different colors, widths, shapes or any combination of the same, to further enhance the security features of the security paper 10. For example, the first filament $\mathbf{14}_1$ may be a first color, such as blue, and the second filament $\mathbf{14}_2$ may be a second color, such as red.

Figure 7:
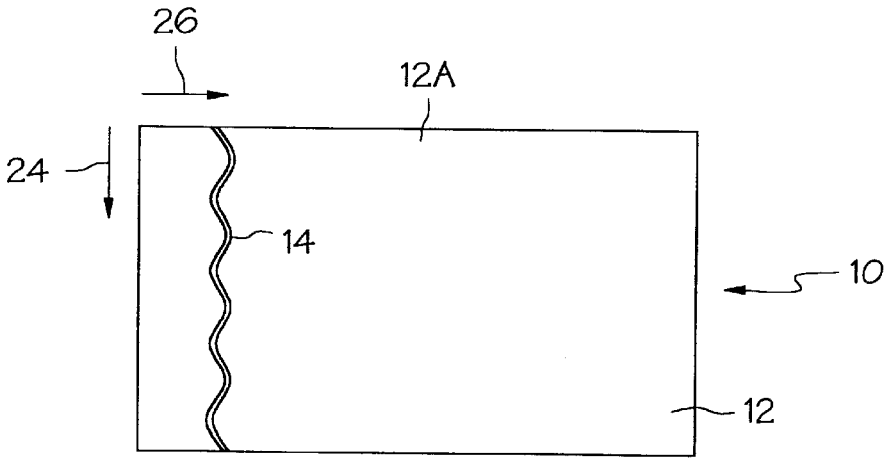
Figure 8:
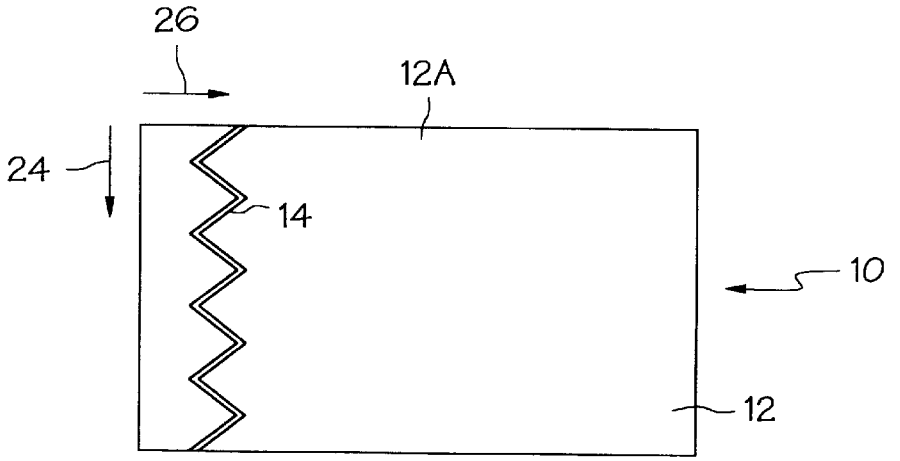

The filament 14 may have a curvilinear pattern as shown in FIG. 7. The curvilinear pattern of the filament 14 is formed by applying the filament 14 to the paper 12 along a curved path. The curvilinear pattern of the filament 14 may be symmetrical, such as a sinusoidal wave, or a random asymmetrical pattern. Similarly, the filament 14 may comprise a single diagonal strip across the surface 12A of the paper 12 or a series of asymmetrical or symmetrical diagonal strips. FIG. 8 illustrates a filament 14 comprising a series of such symmetrical diagonal strips.

Figure 9:
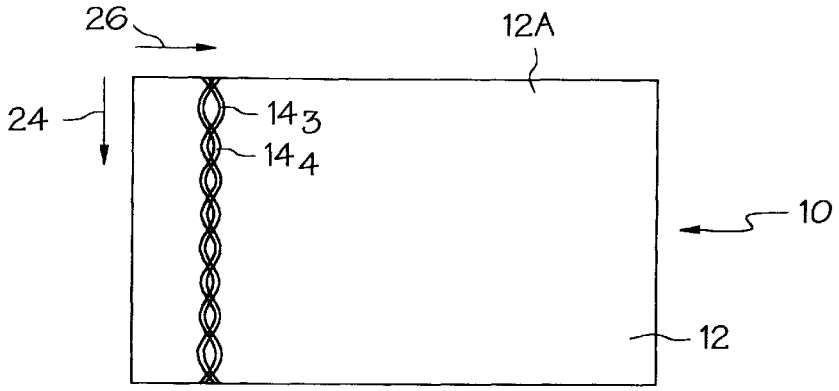

FIG. 9 illustrates a pair of crisscrossing or overlapping filaments $\mathbf{14}_3$ and $\mathbf{14}_4$. As with the filaments $\mathbf{14}_1$ and $\mathbf{14}_2$, the filaments $\mathbf{14}_3$ and $\mathbf{14}_4$ may have different colors, widths, shapes or any combination of the same to further enhance the security features of the security paper 10. The crisscrossing filaments $\mathbf{14}_3$ and $\mathbf{14}_4$ may also be symmetrical, asymmetrical, curvilinear, diagonal or any other reasonable shape. The overlapping filaments $\mathbf{14}_3$ and $\mathbf{14}_4$ may also be formed on opposite surfaces of the paper 12 such that they do not physically touch each other.

Figure 10:
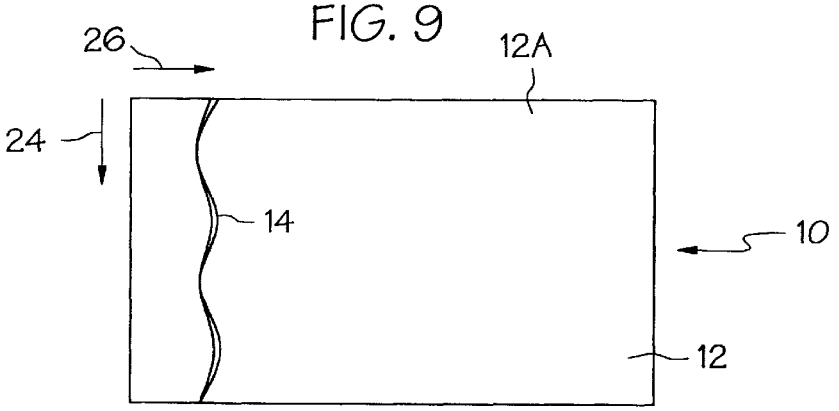

FIG. 10 illustrates a filament 14 having a varying width. The width of the filament 14 may be varied by varying the tension, pressure and/or temperature of the filament 14 as it is applied to the paper 12. A filament 14 with a varying width as shown in FIG. 10 further enhances the security features of the security paper 10, making it more difficult to forge or duplicate.

Figure 11:
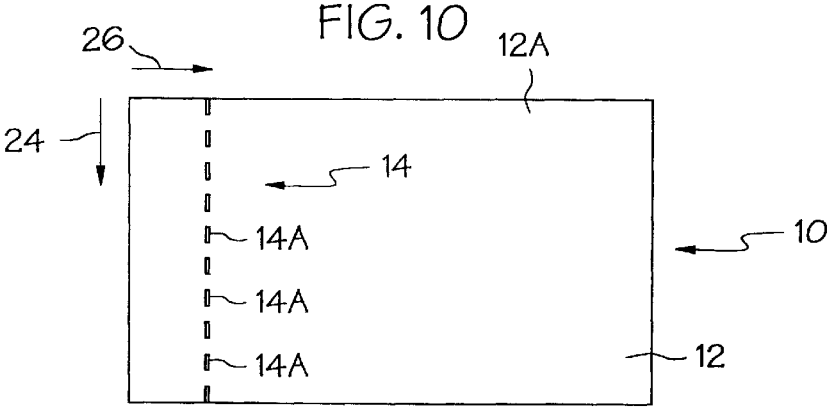
Figure 12:
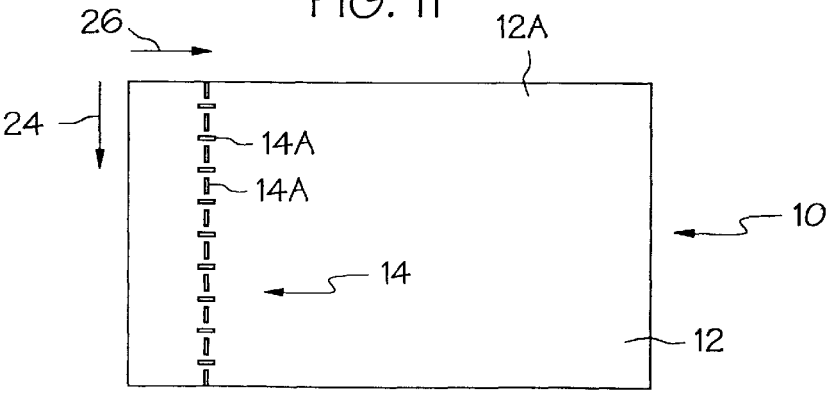

The filament 14 may be a continuous element or discontinuous elements. FIG. 11. illustrates a discontinuous filament 14. The discontinuous filament 14 may be formed of a plurality of individual discrete elements 14A which may be oriented in any desired manner. The discontinuous filament 14 may be straight, curvilinear, or zig-zagged. Further, each of the individual elements 14A may have a different color. While in the illustrated embodiment, the individual elements 14A are formed in the machine direction 24, the individual elements 14A may also be formed along the cross-web direction 26 or interspersed along the machine direction 24 and the cross-web direction 26 as shown in FIG. 13.

The above processes may be used to create the security document 100, as shown in FIG. 4. The security document 100 comprises the security paper 10, as described above. The security paper 10 includes an upper surface 10A which corresponds to the upper surface 12A of the paper 12, and a lower surface 10B which corresponds to the lower surface 12B of the paper 12. The security document 100 is a document of value and may carry printed indicia 120 on one or both surfaces 10A, 10B of the security paper 10. As shown in the illustrated embodiment, the security document 100 carries printed indicia 120 on the upper surface 10A. The printed indicia 120, such as the printed matter for a bank note, may be applied to the upper surface 10A of the security paper 10 through any printing technique commonly used in the art. The filament 114 may be deformed and positioned along the upper surface 10A or lower surface 10B before the printed indicia 120 is applied to the security paper 10 for optimum security and protection. It should be apparent that the filament 114 may be deformed and positioned along the upper or lower surface 10A, 10B during or after the printing of indicia 120 on the security paper 10. In addition, the security paper 10, and hence, the security document 100, may have any combination of security features as described herein. Further, the security paper 10, and hence, the security document 100, may be comprised of paper 12 which has already been manufactured, thereby significantly reducing the manufacturing costs of the security document 100.

Having described the invention in detail and by reference to preferred embodiments thereof, it will be apparent that modifications and variations are possible without departing from the scope of the invention which is defined in the appended claims.

What is claimed is:

1. A process for making security paper comprising:

providing paper having an upper surface and a lower surface;

providing at least one filament;

applying said at least one filament to one of said upper and lower surfaces of said paper;

imprinting a textured pattern into said filament by passing said filament and said paper between calendaring rollers, wherein at least one of said calendaring rollers includes a textured pattern portion.

2. The process of claim 1, wherein the act of applying said at least one filament to one of said upper and lower surfaces of said paper comprises the act of bonding said at least one filament to one of said upper and lower surfaces of said paper using an adhesive.

3. The process of claim 2, wherein said adhesive is applied to said at least one filament prior to applying said at least one filament to said paper.

4. The process of claim 1, wherein the act of applying said at least one filament to one of said upper and lower surfaces of said paper comprises the act of bonding said at least one filament to one of said upper and lower surfaces of said paper by applying heat to said at least one filament.

5. The process of claim 4, wherein said steps of applying heat to said at least one filament and pressing said heated at least one filament and said paper together are accomplished simultaneously.

6. The process of claim 1, wherein at least one of said calendaring rolls are heated.

7. The process of claim 1, wherein said at least one filament is pressed into said paper such that an upper surface of said at least one filament is substantially coplanar with said upper or lower surface of said paper.

8. The process of claim 1, wherein said at least one filament is pressed into said paper such that an upper surface of said at least one filament remains raised above said upper or lower surface of said paper.

9. The process of claim 1, in which the act of applying said at least one filament to one of said upper and lower surfaces of said paper comprises the act of applying said at least one filament to said paper along a substantially linear path.

10. The process of claim 9, in which the act of applying said at least one filament to said paper along a substantially linear path comprises the act of applying said at least one filament in a direction which is substantially parallel to a machine direction of said paper.

11. The process of claim 1, in which the act of applying said at least one filament to one of said upper and lower surfaces of said paper comprises the act of applying said at least one filament to said paper along a curved path.

12. The process of claim 1, in which the act of applying said at least one filament includes the act of varying width of said at least one filament as said filament is applied to said paper.

13. The process of claim 12, wherein the act of varying the width of said at least one filament comprises the act of varying at least one of a temperature, pressure or tension of said at least one filament as said filament is applied to said paper.

14. The process of claim 1, wherein said at least one filament is discontinuous.

15. The process of claim 14, wherein said at least one filament further comprises a plurality of interdispersed elements.

16. The process of claim 1, further comprising:

providing another filament;

applying said another filament to one of said upper and lower surface of said paper; and applying pressure to said another filament and said paper such that said another filament is deformed.

17. The process of claim 16, wherein said at least one filament and said another filament are applied to the same surface of said paper.

18. The process of claim 16, wherein said at least one filament and said another filament are applied to opposite surfaces of said paper.

19. The process of claim 16, wherein said at least one filament and said another filament overlap.

20. The process of claim 16, wherein said at least one filament is a first color and said another filament is a second color.

* * * * *